US006439426B1

(12) United States Patent
Baroncini

(10) Patent No.: US 6,439,426 B1
(45) Date of Patent: Aug. 27, 2002

(54) DEVICE FOR FEEDING TABLETS AND THE LIKE, IN A PACKAGING MACHINE

(75) Inventor: Ivano Baroncini, Osteria Grande (IT)

(73) Assignee: I.M.A. Industria Macchine, Bologna (IT)

( * ) Notice: Subject to any disclaimer, the term of this patent is extended or adjusted under 35 U.S.C. 154(b) by 69 days.

(21) Appl. No.: 09/659,141

(22) Filed: Sep. 11, 2000

(30) Foreign Application Priority Data

Sep. 21, 1999 (IT) ..... BO99A0502

(51) Int. Cl.[7] ..... B65H 31/20
(52) U.S. Cl. ..... 221/241; 53/246
(58) Field of Search ..... 221/241, 296, 221/186, 298, 289, 25, 26, 131; 53/246, 505

(56) References Cited

U.S. PATENT DOCUMENTS 3,775,941 A * 12/1973 Bross ..... 53/246
5,802,804 A * 9/1998 Esposti et al. ..... 53/246

* cited by examiner

*Primary Examiner*—Kenneth W. Noland
(74) *Attorney, Agent, or Firm*—William J. Sapone; Coleman Sudol Sapone, P.C.

(57) ABSTRACT

In a device for feeding tablets to a blister band moving in a packaging machine, a vibrating container, containing a mass of tablets, features a bottom wall having channels for feeding the tablets. The channels communicate with relative slots made in the bottom wall, and the slots communicate with conveying means which feed the tablets along a predetermined feeding path and release the tablets into respective blisters of the blister band. The conveying means include a plate featuring a plurality of grooves, arranged one beside the other, and a covering element. The covering element is coupled with the plate and is adjustable with respect to the plate and has transversal wings situated inside respective grooves of the plate, so as to define respective channels for conveying the tablets. The transversal dimensions of the channels can be changed, while said tablets feeding is stopped, by acting on an adjusting nonius coupled with the conveying means, changing simultaneously also the positions of said wings with respect to the grooves of the plate.

7 Claims, 6 Drawing Sheets

DEVICE FOR FEEDING TABLETS AND THE LIKE, IN A PACKAGING MACHINE

FIELD OF THE INVENTION

The present invention relates to a device for feeding tablets and the like, in a packaging machine.

The present invention is advantageously used for feeding and orderly placing tablets or pills, preferably in pharmaceutical field, into respective blisters of a blister band in a blister packaging machine, to which the following description will refer, while keeping a more general scope.

DESCRIPTION OF THE PRIOR ART

Disc-like or oblong tablets or pills are fed to a packaging machine by a feeding device usually including a vibrating container or a basin, which contains a mass of tablets moving in a circular movement, substantially continuous.

A part of the horizontal flat wall constituting the vibrating basin bottom, features semi-circular ribs, which define channels for feeding and orienting the tablets. Each of the channels opens in the region of a relative slot made in the bottom wall and communicates with an upper end of a corresponding vertical tubular duct, through which the tablets go downwards.

The lower end of the vertical tubular duct is situated over the blister band made of heat-formable material, which moves inside the blister packaging machine.

Therefore, along the tubular channels, groups of tablets are formed which go down one after another toward respective blisters of the blister band, so as to fill the blisters.

The cross section of the tubular channels allow to transport tablets of a determined thickness, and consequently, the channels must be changed with others, of a different cross section, each time the packaging machine must be fed with tablets of a different size or form.

At present, the substitution of the tubular channels is relatively expensive and causes a prolonged stop of the packaging machine, which results in a considerable productivity reduction.

SUMMARY OF THE INVENTION

The object of the present invention is to propose a device for feeding tablets, which avoids the above mentioned problem.

A device for feeding tablets and the like in a packaging machine, obtained according to the present invention includes a vibrating container, which contains a mass of tablets and features a bottom wall, a part of which has tablets feeding channels communicating with relative slots made in said bottom wall; and conveying means for conveying said tablets along a predetermined feeding path and releasing the tablets into respective blisters of a blister band, which moves inside the packaging machine, said conveying means communicating with said slots, the device being characterized in that said conveying means include a plate featuring at least two grooves, arranged one beside the other, and a covering element, coupled with said plate, so as to be adjustable with respect to said plate and equipped with transversal wings, each of which is situated inside a respective groove of the plate, so as to define a respective channel of a predetermined transversal dimension for conveying the tablets; adjusting means being coupled with said conveying means, for adjusting, while the tablets feeding is stopped, the positions of said wings with respect to the grooves in order to change the transversal dimensions of said conveying channels.

BRIEF DESCRIPTION OF THE DRAWINGS

The present invention is described with reference to the enclosed drawings illustrating two non limitative embodiments, in which.

DESCRIPTION OF THE PREFERRED EMBODIMENTS

Figure 1:
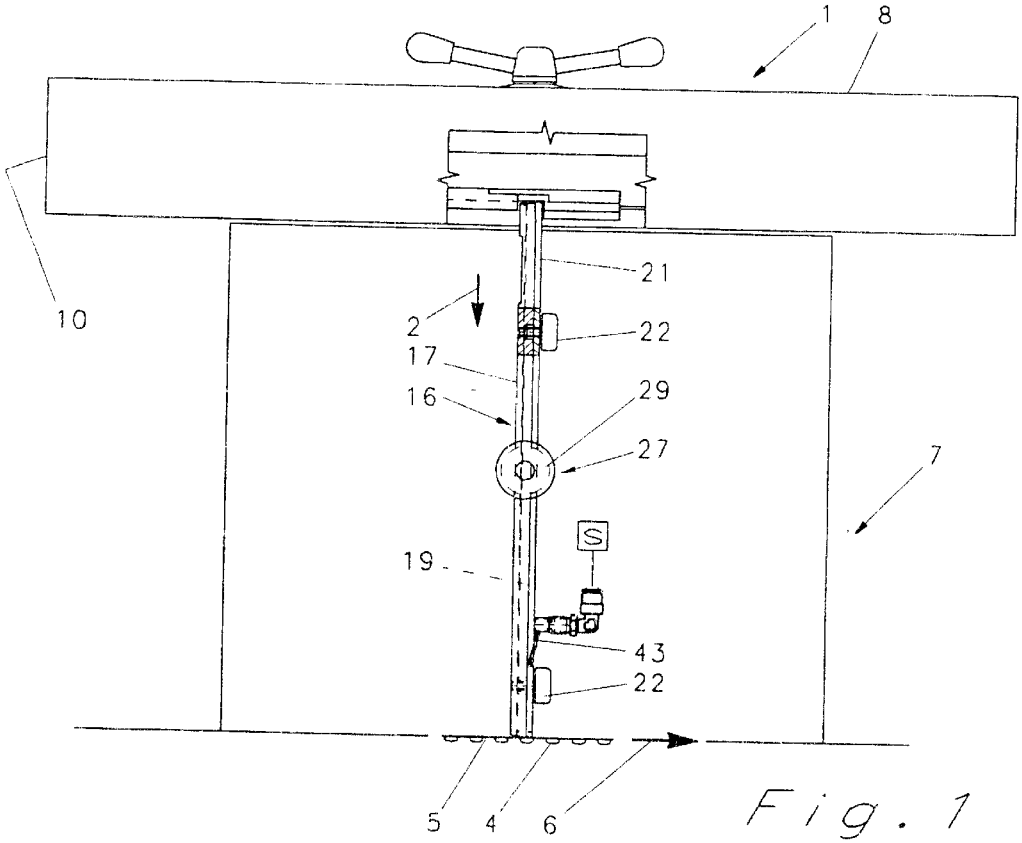
FIG. 1 is a schematic front view, partially in section and with some parts removed for clearness, of a preferred embodiment of the proposed device for feeding tablets.
Figure 2:
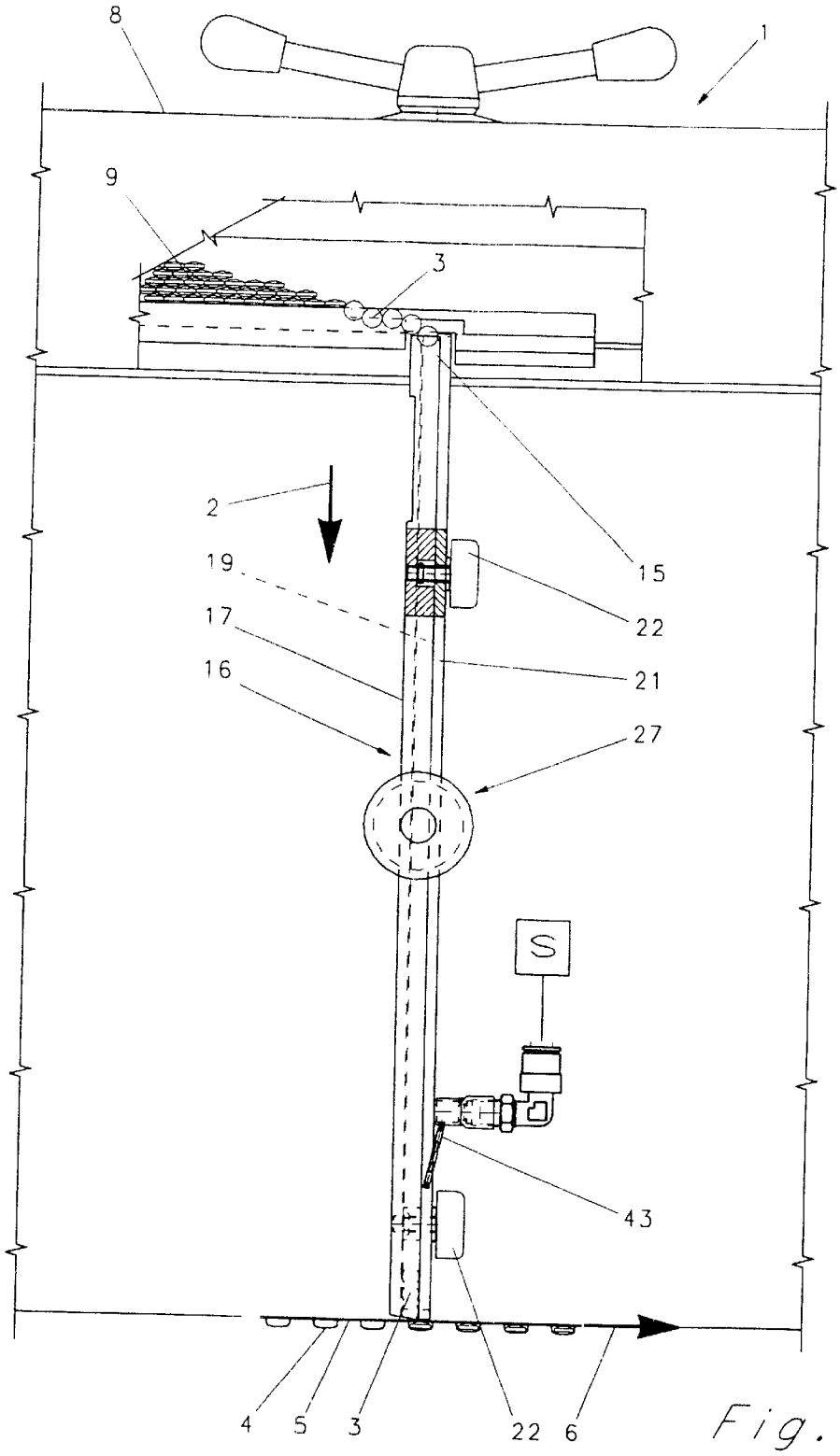
FIG. 2 is an enlarged view, partially in section and with some parts removed for clearness, of the device of FIG. 1.
Figure 3:
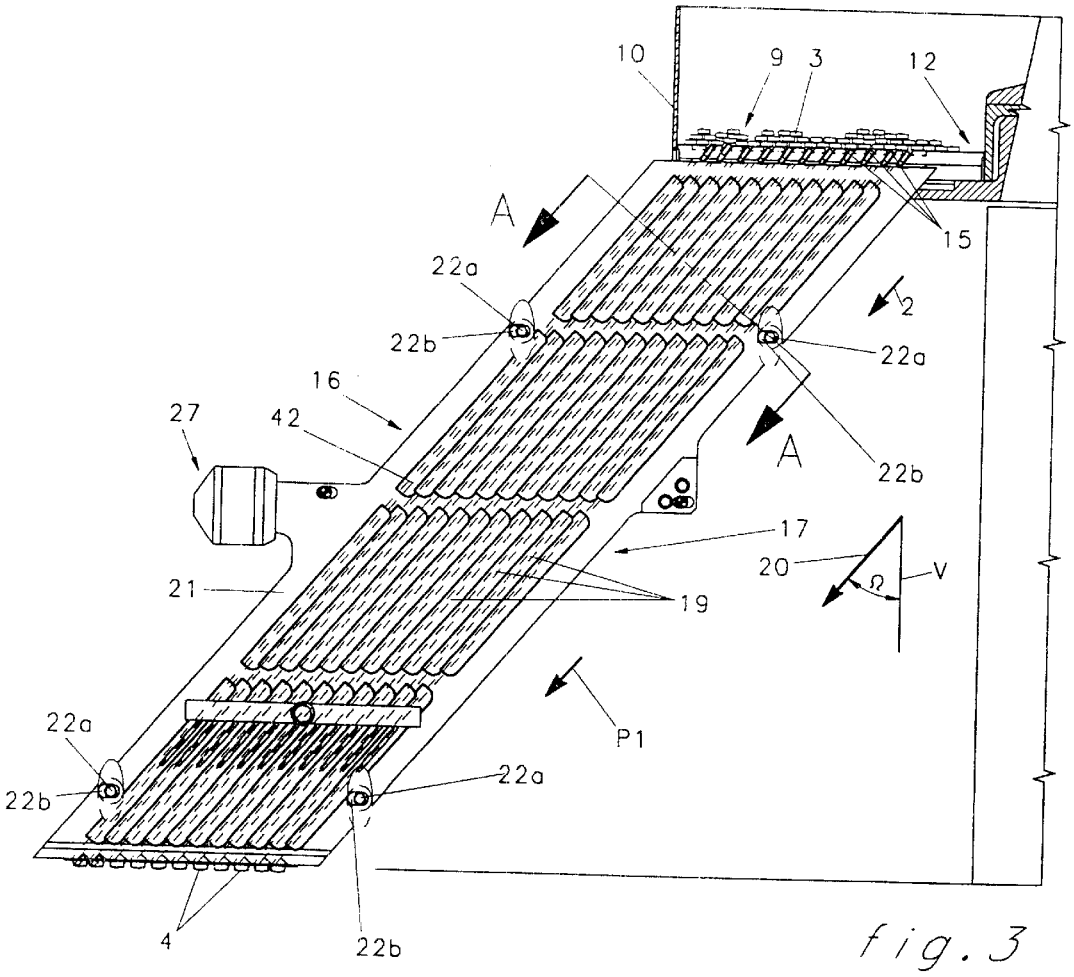
FIG. 3 is a lateral schematic view of the device of FIG. 1.

With reference to FIGS. 1, 2 and 3, the reference numeral 1 indicates a device for feeding tablets 3, preferably pharmaceutical, along a path 2, and subsequently for releasing the tablets 3 into respective blisters 4 of a blister band 5.

The blister band 5 moves in a direction, indicated by 6, inside a packaging machine 7. The device 1 is an integral part of the packaging machine.

The device 1 includes a container or circular basin 8, driven into vibration in known way by actuator means, known and not shown, and aimed at containing a mass 9 of tablets 3 moving in a substantially continuous circular flow.

Figure 5:
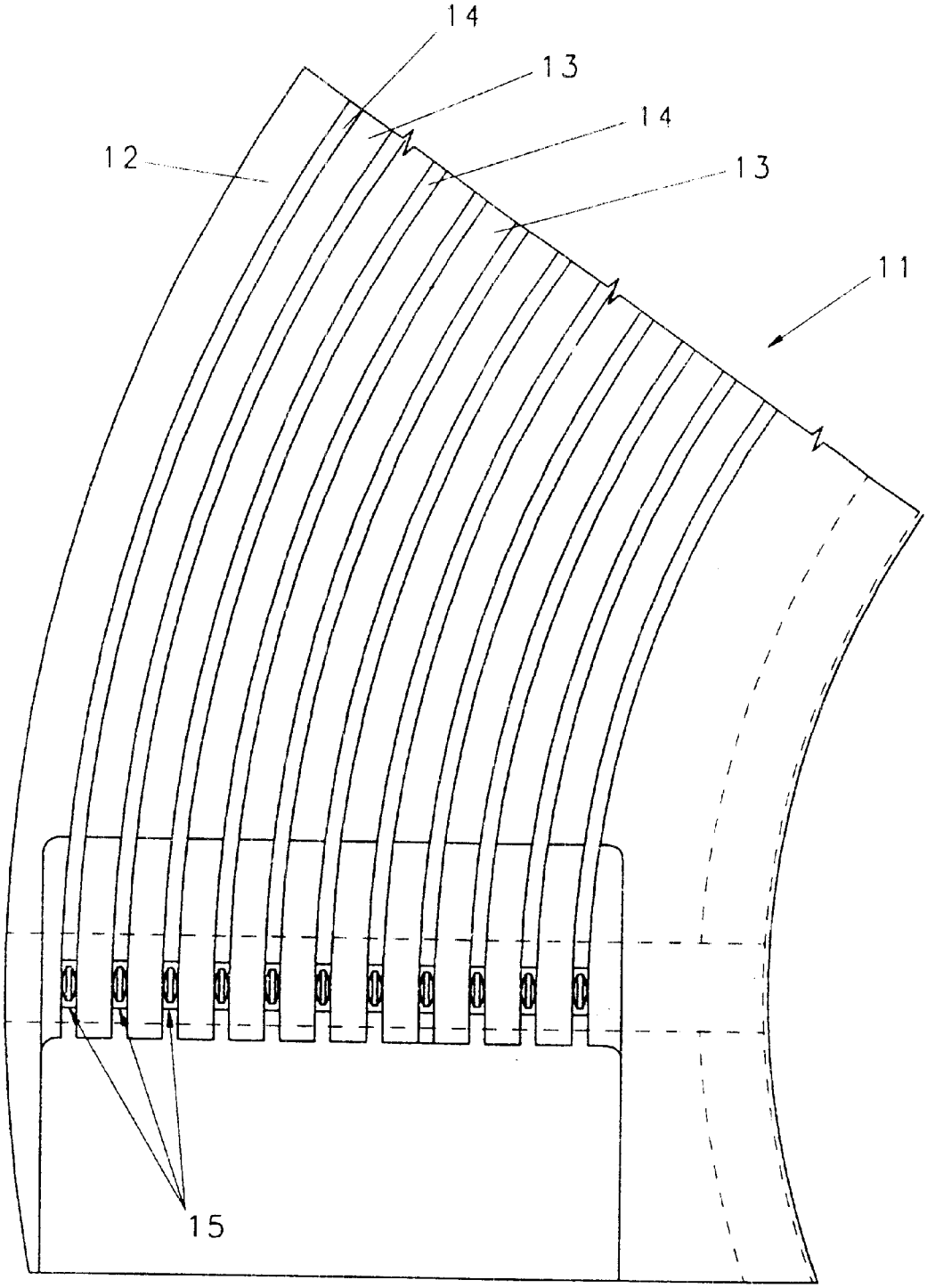
FIG. 5 is a plan view of another particular of FIG. 3.

As seen in FIGS. 1, 3 and 5, the vibrating basin 8 has a lateral cylindrical wall 10 and a horizontal bottom wall 11.

A part 12 of the bottom wall 11 features a plurality of semi-circular ribs or guides 13.

The guides 13 define, on the bottom wall 11 of the basin 8, respective channels 14 for feeding and orienting tablets 3.

Each of the channels 14 opens in the region of a relative slot 15 made in the bottom wall 11.

As seen in FIGS. from 2 to 5, the slots 15 communicate with tablets 3 conveying means 16, which include a plate 17, with a plurality of grooves 18 made therein.

The transversal dimension, or width L of each of the grooves 18, preferably of square (FIG. 4) or semi-circular (not shown) cross section, is substantially equal to a multiple of the value H corresponding to the thickness of a tablet 3.

The grooves 18 are arranged one beside another and define respective channels 19, which convey groups or continues columns of tablets 3 along a portion P1 of the path 2 in a feeding direction 20, which is inclined by an angle Ω with respect to the vertical.

The angle Ω is preferably equal to 45°.

The conveying means 16 include also a cover 21, coupled with the plate 17 by hand-wheels 22, which are fastened to the cover 21 by respective screws 22*a* passing through the slits 22*b* made in the cover 21.

Figure 4:
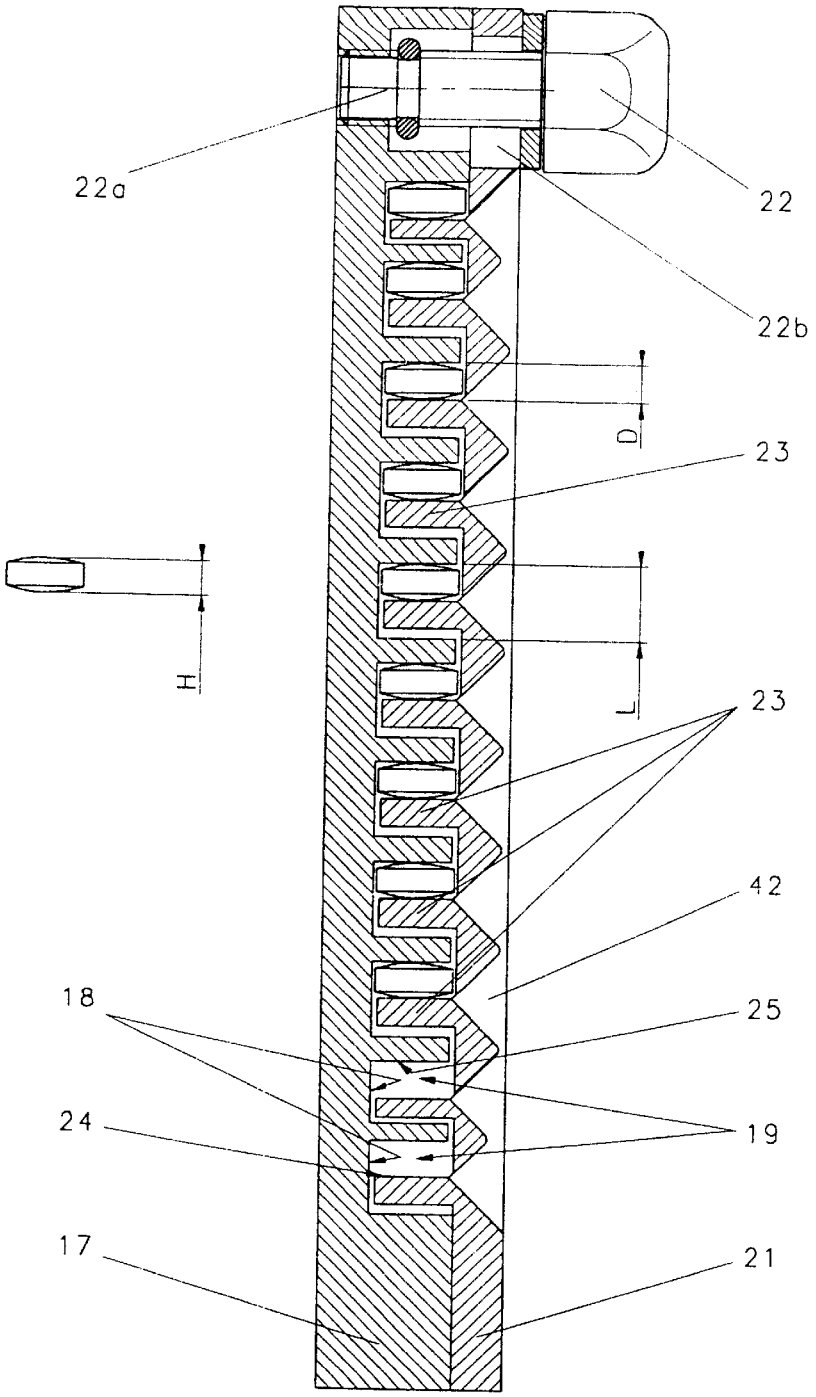
FIG. 4 is a plan, section view, taken along a line (A—A) of a particular of FIG. 3.

As better seen in FIG. 4, the cover 21 features transversal wings 23, which, when the cover 21 is coupled with the plate 17, are situated each one in a respective groove 18 of the plate 17, so as to define a lateral wall 24 of a channel 19 conveying the tablets 3.

In particular, the transversal dimension D or width of a channel 19, measured between the lateral wall 24 and a lateral wall 25 of the groove 18, is substantially equal to the thickness H of the tablet 3.

Adjusting means 27, fastened to the conveying means 16 in the region of a flange 26 extending from the plate 17, allow to change, while the feeding operations are stopped for tablets size change, the transversal dimension D of the channels 19, so as to feed tablets 3, whose thickness H' is different from the thickness H.

Figure 6A:
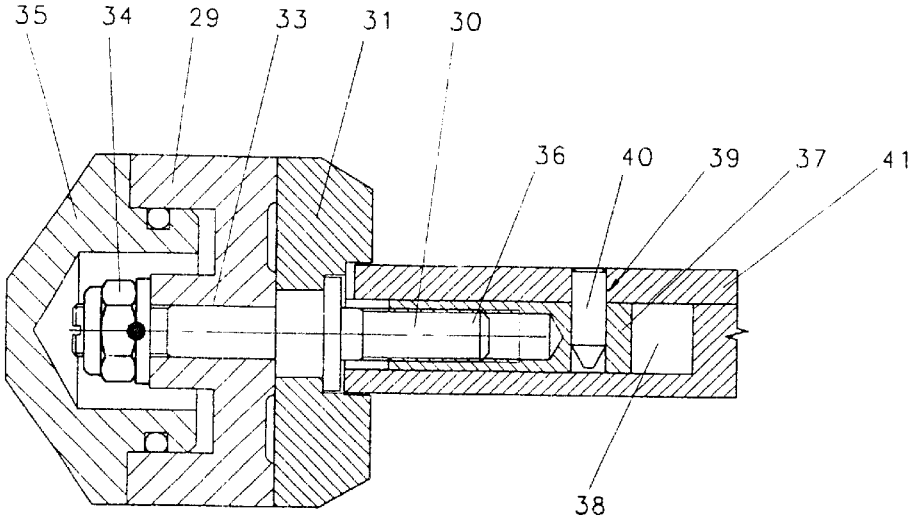
FIGS. 6*a* and 6*b* are plan and front sectional views, respectively, of another particular of FIG. 3.
Figure 6B:
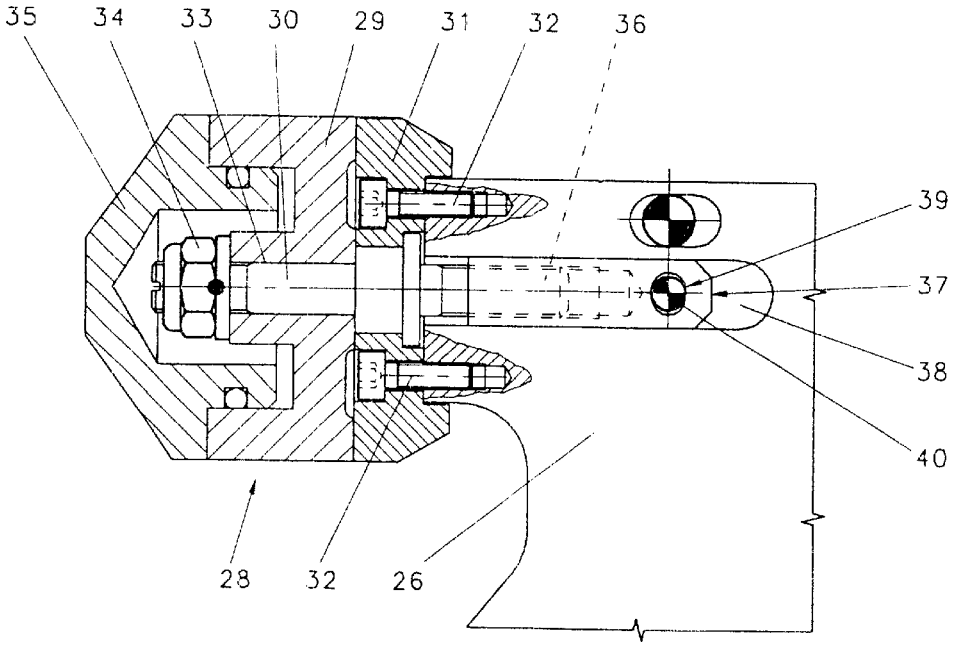

As better seen in FIGS. 3, 6*a* and 6*b*, the adjusting means 27 include a (nonius) 28 equipped with a graduated grip 29, which is coupled with an adjusting pin 30 and which can rotate freely in both rotation directions with respect to a block 31 provided with a reference sign or notch and fastened to the flange 26 of the plate 17 by screws 32.

A threaded end 33 of the pin 30 carries a screw nut 34, which fastens the grip 29 to the pin 30 and supports a lid 35, while the opposite threaded end 36 is situated inside a key 37, which moves in a throat 38 of the flange 26.

The key 37 features also, made therein, a hole 39 for housing a peg 40, which fastens a flange 41 extending from the cover 21 to the key 37.

As seen in FIGS. 3 and 4, the cover 21 features a plurality or a matrix of inspection slots 42, which are aimed at, when in use, inspecting visually the downward flow of the tablets 3 along the channels 19.

Moreover, the cover 21 is equipped with nozzles 43 communicating with a source of air S, which blows pressured air through the inspection slots 42 in a direction substantially parallel to the direction 20, so as to further facilitate the descent of the tablets 3 inside the channels 19.

Figure 7:
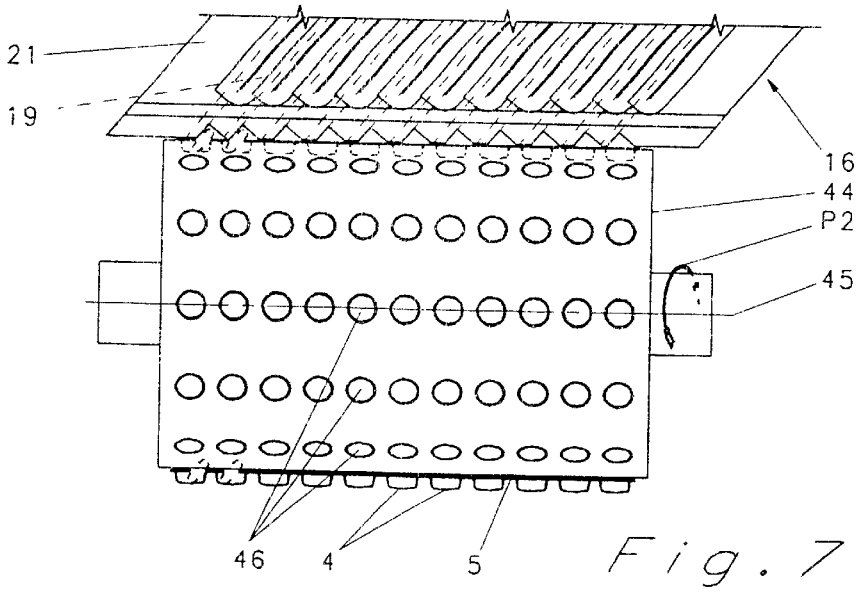
FIG. 7 is a schematic lateral view of the device of FIG. 1.

According to the version shown in FIG. 7, the conveying means 16 include also a conveying recessed roller 44, situated directly under the group defined by the plate 17 and the cover 21 coupled therewith, between this group and the band 5.

The conveying recessed roller 44 rotates about its horizontal axis 45 and each of its recesses 46 receives one of the tablets 3 leaving the channels 19 and feeds it to the band 5, along a curved portion P2 of the path 2, so as to release, in known way, in step relation, the tablet 3 into respective blister 4 of the band 5.

During a normal feeding step, the tablets 3 of thickness H move along the channels 14 of the basin 8 and, after having reached the slots 15, fall into the respective vertical channels 19, in which continuous columns of tablets 3 are formed.

The tablets 3 move along the channels 19 and fall one after another into the blisters 4 of the blister band 5, or, according to the other version, into the recesses 46 of the roller 44, which subsequently release the tablets 3 to the blisters 4 of the blister band 5.

In case it is necessary to package tablets 3 of a thickness H', different from the thickness H, first the channels 19 are completely emptied and the packaging machine 7 is stopped. Later on, after the hand-wheels 22 fastening the cover 21 to the plate 17, have been released, the graduated grip 29 is acted on, so as to move the cover 21 with respect to the plate 17, i.e. to move the wings 23 inside the grooves 18.

Therefore, only one rapid and extremely precise operation adjusts simultaneously the dimension D of each channel 19, so as to adapt it perfectly to the new thickness H' of the tablets 3 to be fed.

At this point, after having fastened again the cover 21 to the plate 17 by the fastening hand-wheels 22, and possibly, after having substituted the blister band 5 with another, featuring blisters of dimensions suitable to the new thickness H' of the tablets 3, a new step of feeding the tablets 3 to the packaging machine can be started.

What is claimed is:

1. A device for feeding tablets to a blister band moving in a packaging machine, said device including:

a vibrating container, which contains a mass of tablets and which features a bottom wall, a part of which has tablets feeding channels, said feeding channels communicating with relative slots made in said bottom wall;

conveying means for conveying said tablets along a predetermined feeding path and releasing said tablets into respective blisters of said blister band, said conveying means communicating with said slots and further including:

a plate featuring at least two grooves, arranged one beside the other and a covering element, coupled with said plate and adjustable with respect to said plate;

transversal wings situated inside respective grooves of the plate, so as to define respective channels having predetermined transversal dimension for conveying said tablets;

adjusting means coupled with said conveying means, for adjusting, while said tablets feeding is stopped, the positions of said wings with respect to the grooves in order to change the transversal dimensions of said conveying channels.

2. A device, according to claim 1, wherein said adjusting means include a nonius equipped with a graduated grip, which is coupled with an adjusting pin and which can rotate freely in both rotation directions with respect to a reference block fastened to a flange of said plate, with one threaded end of said pin being situated inside a key;

said key moving inside a throat of said flange of said plate and featuring also a hole for housing a peg, said peg fastening a flange, extending from said covering element, to said key.

3. A device, according to claim 1, wherein said conveying channels define a direction for feeding the tablets along a straight portion of said path; said direction being inclined by a pre-selected angle with respect to the vertical.

4. A Device, according to claim 3, wherein the value of said pre-selected angle is 45°.

5. A device, according to claim 1, wherein said conveying means include also a conveying recessed roller, situated between said plate and the group formed by the covering element and said band; said conveying recessed roller rotating about an horizontal axis parallel to said band, with recesses of said recessed roller receiving said tablets leaving said conveying channels and feeding said tablets to said band, along a curved portion of said feeding path, so as to release, in known way and in step relation, said tablets into respective blisters of the band.

6. A device, according to claim 1, wherein said covering element is also equipped with a plurality, or a matrix, of inspection slots, which are aimed, when in use, at inspecting visually the downward flow of said tablets along the conveying channels.

7. A device, according to claim 6, further including nozzles communicating with a source of compressed air, so as to blow pressured air through said inspection slots in a direction substantially parallel to said tablets feeding direction.

* * * * *